United States Patent [19]

Collins

[11] Patent Number: 4,815,370

[45] Date of Patent: Mar. 28, 1989

[54] RICE PRESS ROLLERS

[76] Inventor: Michael Collins, 100 Lawrence Ave., Fountain Inn, S.C. 29644

[21] Appl. No.: 117,838

[22] Filed: Nov. 9, 1987

[51] Int. Cl.[4] ..... B02B 3/04

[52] U.S. Cl. ..... 99/618; 29/110; 29/123; 29/132; 99/620; 99/621; 100/176; 100/211; 241/230; 241/234

[58] Field of Search ..... 99/524, 609, 618, 621, 99/620, 625; 100/176, 155 R, 172, 211; 29/110, 115, 121.1, 123, 124, 132; 68/248, 244; 118/114, 116; 241/221, 293, 230, 234, DIG. 30

[56] References Cited

U.S. PATENT DOCUMENTS

| | | | |
|---|---|---|---|
| 2,685,548 | 8/1954 | Drozdowski | 100/176 |
| 3,990,802 | 11/1976 | Corona | 29/123 X |
| 4,256,034 | 3/1981 | Kusters et al. | 100/176 X |
| 4,291,438 | 9/1981 | Seiki et al. | 29/121.1 X |
| 4,416,201 | 11/1983 | Kessler | 29/123 X |
| 4,432,275 | 2/1984 | Zekert et al. | 99/621 X |
| 4,517,719 | 5/1985 | Okumura et al. | 29/132 X |
| 4,558,725 | 12/1985 | Veneziale | 100/176 X |
| 4,662,274 | 5/1987 | Nonomiya et al. | 99/621 X |

*Primary Examiner*—Timothy F. Simone
*Attorney, Agent, or Firm*—Bailey & Hardaway

[57] ABSTRACT

In a rice pressing apparatus having mating rollers mounted in parallel at a specific gap, each roller comprising a slightly tapered metal hub of aluminum or an aluminum-zinc alloy, a removable rubber sleeve and retaining caps at each end to maintain proper alignment of parts. The hub includes external splines which dovetail with internal splines of the rubber sleeve.

8 Claims, 2 Drawing Sheets

RICE PRESS ROLLERS

BACKGROUND OF THE INVENTION

This invention relates generally to the art of rice shelling machinery and more particularly to the art of rice shelling machinery employing mating rollers.

The rice milling process, which removes the hull and other portions of bran and germ to yield the endosperm, involves various abrasive and separatory procedures. Attention is directed to the specific procedure for removing the hull or husk from the remaining kernel, i.e., the shelling procedure. The shelling procedure follows cleaning the paddy or rough rice and loosens the coarse husk from the kernel by either disk or rubber roll shellers. In recent times, the more efficient rubber roll sheller has been increasingly used, replacing the disk sheller in the marketplace since it provides a greater yield of hulled and undamaged kernels.

Rubber-surfaced rolls are positioned in parallel at a specific gap and rotate towards each other as rough rice is fed between them. This action results in a gentle removal of the husk which leaves the endosperm primarily intact, a prerequisite stage to further refinement of the kernel. Use of the currently employed rubber-surfaced rolls, however, has severe drawbacks due to both production and maintenance considerations. The roll consists of a hollow steel hub with a rubber surface. In order to manufacture the roll, the ductile steel herb must be sand-cast. The hub is then shaped by machine to produce both inside and outside finished dimensions. The rubber surface of the roll must be bonded to the steel hub in order to secure it in position. This procedure includes coating the hub with the bonding agent and loading it into a compression or transfer mold. Once bonded, machine shaping is required again to bring the rubber surface coaxial with the hub. Finally, all exposed metal surfaces of the hub require painting in order to prevent rusting. The procedure is time consuming and involved, and is currently being performed outside the country.

Furthermore, the life expectancy of the finished product averages only 2.6 days. But, since the process of refurbishing used rolls is extremely costly, inherently problematic and results in a product of lesser quality than a new one, new rolls are supplied when needed. Production time and intricacy combine with freight costs and shipping time to present major obstacles to the employment of the roll used currently in rice shelling machinery.

Specialized machines have existed within the prior art which address various separatory procedures. U.S. Pat. No. 4,393,762 to Jacobs discloses a machine for dehulling flat disc-like seeds whereby a spinning rotor throws the seeds against an annular impact band to crack the hull. In U.S. Pat. No. 4,459,903 to Yamamoto, an abrasive roll rice polishing machine is disclosed. But, a need exists within the rice milling process for improving the rice shelling procedure, particularly by addressing machines employing mating rollers.

SUMMARY OF THE INVENTION

It is thus an object of this invention to provide a novel apparatus which is an improvement in composition and construction over the roller currently used in a rice pressing machine.

It is a more particular object of this invention to provide a novel apparatus which lasts longer initially than the currently employed roller and is readily refurbished for additional use.

It is a further object of this invention to provide a novel apparatus to assist in processing more patties in a given unit of time.

It is still a further object of this invention to provide a novel apparatus which is less costly to procure as a result of its being manufactured and refurbished in this country.

These as well as other objects are accomplished by an improved roller for use in a rice pressing machine, two of which are mounted in parallel for pressing rice therebetween, one roller comprising a hollow, cylindrical hub having a distal end and a proximal end and having external splines disposed circumferentially along its longitudinal axis, a rubber sleeve defining a chamber and having internal splines disposed into the chamber along its longitudinal axis for the purpose of dovetailing with the external splines of the hub, a retaining cap at both distal and proximal ends for maintaining the alignment of the sleeve with the hub, means for securing the retaining caps to the hub and means for securing the hub to a drive system.

DETAILED DESCRIPTION OF THE DRAWINGS

In accordance with this invention, there is provided an improvement of the rubber-surfaced roll or roller currently used in a rice shelling or pressing machine. The metal portion (hub and retaining caps) of the apparatus of the instant invention is aluminum or an aluminum-zinc alloy which provides several advantages over the use of steel. First, it is less dense and its lighter weight insures easier installation onto the shaft of the drive system and reduces the cost of freighting the product. Secondly, it will not rust which precludes painting any exposed metal surfaces of the finished product. In addition, aluminum and aluminum-zinc alloys dissipate heat readily. Since heat retention is a major factor in causing the part to wear, the life of the aluminum hub is extended substantially. Further, due to the fact that less heat is being retained, the speed of rotation of the rollers can be increased allowing more patties to be processed in a given unit of time.

Because of the design and construction of the parts of the roller, it is not necessary or appropriate that the rubber sleeve be bonded onto the hub. The sleeve is readily applied to the hub at its slightly tapered or drafted end, and the sleeve is likewise readily removed without damage to the hub. A new rubber sleeve replaces the worn-out sleeve at the proper time allowing for further use of the original hub.

One major advantage of the roller of the instant invention is that all parts can be manufactured in this country. In addition, the rubber sleeve, manufactured in an injection press which greatly reduces production time, can be installed on location in just a few minutes.

The above factors combine to provide a much more cost-efficient product than the roller currently employed in the industry. These, as well as other advantages, will be apparent from the following description and reference to the figures of drawings.

Figure 1:
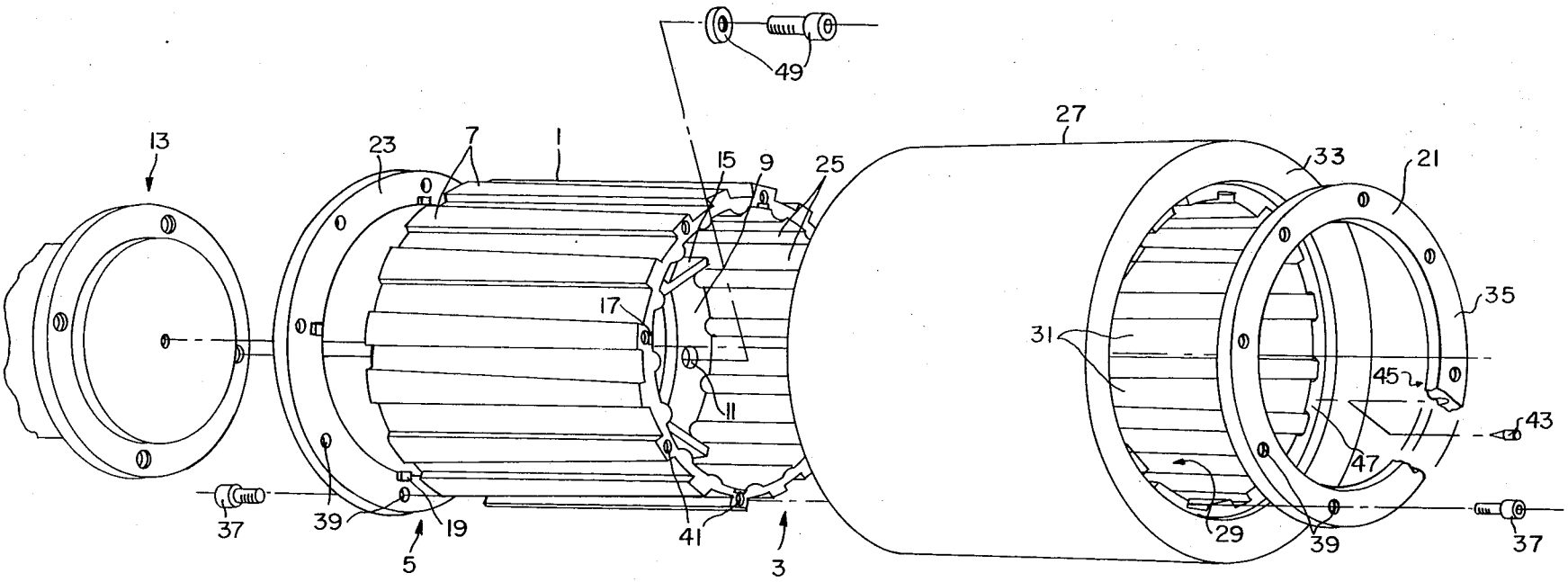
FIG. 1 of the drawings is an exploded view of the apparatus in accordance with this invention illustrating the hub, rubber sleeve, retaining caps and the associated drive system.
Figure 2:
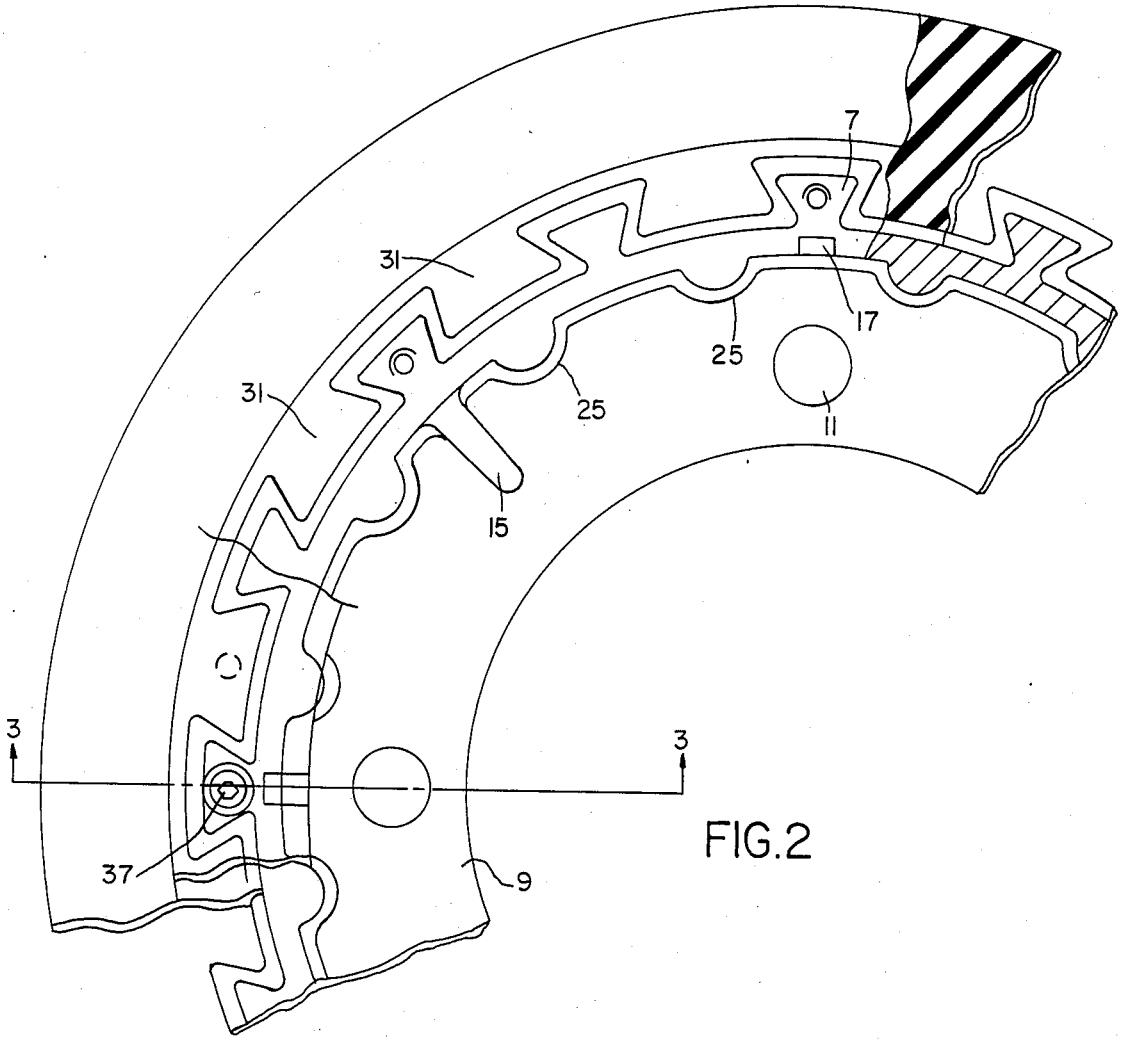
FIG. 2 of the drawings is a partial end view of the apparatus in accordance with this invention.
Figure 3:
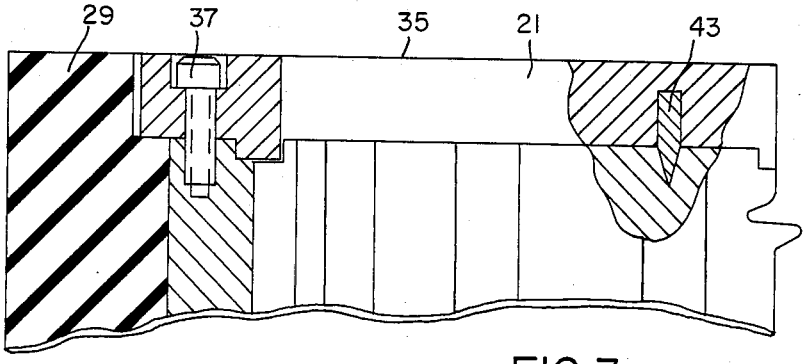
FIG. 3 of the drawings is a partial section view along the plane indicated by the line 3—3 of FIG. 2.

FIG. 1 of the drawings illustrates the apparatus of the invention including a hollow, cylindrical metal hub 1 having proximal end 3 and distal end 5 and also having splines 7 disposed circumferentially along its longitudinal axis. Hub 1 also has an internal flange 9 with a plurality of fastener openings 11 for attaching hub 1 to a drive system 13. A plurality of angled gussets 15 reinforce flange 9. A plurality of keyways 17 at both proximal end 3 and distal end 5 of hub 1 are aligned opposite a plurality of keys 19 on proximal retaining cap 21 and distal retaining cap 23. Keys 19 kit inside keyways 17 when retaining caps 21 and 23 abut hub 1 to insure proper alignment of parts as shown in FIG. 2 and FIG. 3. Hub 1 further includes internal convolutions 25 along its longitudinal axis, as illustrated in FIG. 2, proving an additional measure of strength to hub 1.

Rubber sleeve 27, defining chamber 29, has internal splines 31 disposed into chamber 29 along its longitudinal axis for the purpose of dovetailing with the external splines 7 of hub 1. Hub 1 has a slight draft toward proximal end 3, as seen in FIG. 1, which allows for the force-fit of rubber sleeve 27 onto hub 1. Rubber sleeve 27, properly positioned onto hub 1, overhangs slightly at both distal end 5 and proximal end 3, as illustrated in FIG. 3. When retaining cap 21 (see FIG. 3) is properly positioned onto the proximal end 3 of hub 1, the terminal edge 33 of rubber sleeve 27 aligns with the outward edge 35 of retaining cap 21. Similarly, alignment results at the distal end 5 of hub 1 (not shown) when retaining cap 23 is properly positioned.

Illustrated in all three figures of drawing is means for securing retaining caps 21 and 23 to hub 1, which comprises a plurality a fasteners 37 passing through a plurality of fastener openings 39 in caps 21 and 23 into a plurality of threaded receptacles 41 on hub 1. In addition, retaining cap 21 at proximal end 3 of hub 1 includes a plurality of tapered pins 43 extending from its inward edge 45 to be forced into the exposed edges 47 of splines 31 of the rubber sleeve 27 in order to insure a close fit a sleeve 27 onto hub 1. Means for securing hub 1 to drive system 13 comprises a plurality of drive system fasteners 49 which pass through a plurality of fastener openings 11 in flange 9. As the drive system is operated, rollers mounted in parallel at a specific gap rotate toward each other while patties are fed between them, breaking the husk of the patties.

It is thus seen that the apparatus of the instant invention has distinct advantages over the rubber-surfaced steel roller currently used in a rice shelling or pressing machine. Parts for the apparatus can be manufactured in this country for greater availability when needed, reducing freight costs considerably. The hub of aluminum or aluminum-zinc alloy is lighter in weight and more easily manipulated than steel. In addition, the hub readily dissipates heat which extends the life of the part and allows for higher operating speeds to process more patties in a unit of time. A worn rubber sleeve is readily replaced without damage to the hub, and replacement of the sleeve onto the hub can be done on location. As variations of the apparatus of the instant invention will be apparent to one of skill in the art, such variations are within the spirit and scope of this invention as defined by the following appended claims:

That which is claimed:

1. In a rice pressing apparatus having parallel mating rollers for pressing rice therebetween, the improvement comprising one of said rollers, said roller comprising:

a hollow cylindrical metal hub having a distal end and a proximal end and having external splines disposed circumferentially along the longitudinal axis thereof;

a rubber sleeve defining a chamber and having internal splines disposed into said chamber along the longitudinal axis thereof for the purpose of dovetailing with said external splines of said hub;

a retaining cap at said distal end and at said proximal end, each with a plurality of fastener openings, for maintaining proper alignment of said rubber sleeve with said hub;

means for securing said retaining caps to said hub; and, means for securing said hub to a drive system.

2. In the rice pressing apparatus having parallel mating rollers for pressing rice therebetween in accordance with claim 1, said hub having a slight draft toward said proximal end allowing for the force-fit of said rubber sleeve onto said hub.

3. In the rice pressing apparatus having parallel mating rollers for pressing rice therebetween in accordance with claim 2, said hub having internal convolutions along the longitudinal axis thereof.

4. In the rice pressing apparatus having parallel mating rollers for pressing rice therebetween in accordance with claim 2, said hub including an internal flange with a plurality of fastener openings for attaching said hub to a drive system and a plurality of angled gussets for reinforcing said flange, and said hub further including a plurality for keyways at said distal end and said proximal end for connecting with said retaining caps.

5. In the rice pressing apparatus having parallel mating rollers for pressing rice therebetween in accordance with claim 1, said retaining caps including a plurality of keys situated opposite said keyways of said hub for inserting into said keyways of said hub.

6. In the rice pressing apparatus having parallel mating rollers for pressing rice therebetween in accordance with claim 1, said hub and said retaining caps being aluminum or an alloy of aluminum and zinc in composition.

7. In the rice pressing apparatus having parallel mating rollers for pressing rice therebetween in accordance with claim 1, said retaining cap at said proximal end of said hub including a plurality of tapered pins for extending into said splines of said rubber sleeve insuring a tight fit of said sleeve onto said hub.

8. In the rice pressing apparatus having parallel mating rollers for pressing rice therebetween in accordance with claim 1, both of said rollers being appropriately mounted on said drive system for rotating toward each other.

* * * * *